United States Patent [19]

Cicin-Sain

[11] Patent Number: 4,542,697

[45] Date of Patent: Sep. 24, 1985

[54] TRAIN FOR LAYING A NEW RAILROAD TRACK

[75] Inventor: Ivo Cicin-Sain, Bussigny, Switzerland

[73] Assignee: Matisa Materiel Industriel S.A., Crissier, Switzerland

[21] Appl. No.: 471,245

[22] Filed: Mar. 2, 1983

[30] Foreign Application Priority Data

Mar. 12, 1982 [CH] Switzerland ..... 1523/82

[51] Int. Cl.[4] ..... E01B 27/08

[52] U.S. Cl. ..... 104/2; 104/6; 104/7 R

[58] Field of Search ..... 104/2–17 A

[56] References Cited

U.S. PATENT DOCUMENTS

| | | | |
|---|---|---|---|
| 758,524 | 4/1904 | Goldie | 104/2 |
| 2,818,820 | 1/1958 | Williams | 104/2 |
| 3,120,819 | 2/1964 | Gammie | 104/5 |
| 3,146,727 | 9/1964 | Plasser et al. | 104/2 |
| 4,357,874 | 9/1982 | Theurer | 104/2 |

FOREIGN PATENT DOCUMENTS

| | | | |
|---|---|---|---|
| 60590 | 10/1984 | European Pat. Off. | 104/2 |
| 2419998 | 10/1979 | France | 104/2 |
| 600045 | 6/1978 | Switzerland | 104/2 |
| 600046 | 6/1978 | Switzerland | 104/2 |
| 403802 | 1/1974 | U.S.S.R. | 104/5 |

OTHER PUBLICATIONS

Track, Oct. 1963, Laying Two Long Rails at the Same Time.

*Primary Examiner*—Trygve M. Blix
*Assistant Examiner*—Stephen P. Avila
*Attorney, Agent, or Firm*—Robert E. Burns; Emmanuel J. Lobato; Bruce L. Adams

[57] ABSTRACT

A train for laying railroad track comprises cars for storing ties and a single working truck carrying a gantry and conveyor for transporting ties from the storage cars and laying them in front of the working truck. Roller clamps at opposite sides of the working truck move rails from the sides of the road bed and positioned them on the ties that have been laid. The working truck has a rear bogie running on the rails after they have been positioned and a front bogie supported by a carriage sliding or rolling on railless ties that have been laid on the road bed. The tie laying device is supported in overhanging relationship by the front end of the working truck together with a device for levelling and/or tamping the platform or ballast.

9 Claims, 3 Drawing Figures

TRAIN FOR LAYING A NEW RAILROAD TRACK

BACKGROUND OF THE INVENTION

1. Field of the Invention

The present invention relates to a train for laying a new railroad track, which comprises at least means for transporting and laying the cross-ties, rail positioning means and tie storage cars.

2. Description of the Prior Art

It is already known from the Swiss Patent No. CH-A-600,045 to construct a railroad renewal train comprising two hingedly interconnected trucks supporting the various working tools for removing the old track and laying the new track, together with one or more cars for storing the new and old cross-ties. The storage cars and the first truck, usually referred to as the tie handling car, travel on the old track while the second truck rolls on the renewed track. During the works, the tie handling car is carried at its front end by a bogie and at the rear end by a pair of retractable bearings rolling on an auxiliary runway consisting of the new rails to be laid on the track but deposited beforehand on both sides of the old track and externally of the ties. The second or power truck is supported at its front end by the tie handling car and at its rear end by a bogie rolling on the renewed track.

Another Swiss Patent No. CH-A-600,046 discloses a track renewal train similar to the one described in the above-mentioned Swiss Patent No. CH-A-600,045 but adapted, at the cost of a few transformations, to be used as a railroad track laying train (cf. FIGS. 5 and 6). The track laying train operates in the direction opposed to that of the track renewing train. The retractable rolling bearings are disposed on either side of the single bogie of the power truck, whereby this power truck travels on the rails disposed directly on the platform of the future track and set at the proper gage by the rolling bearings. The tie laying device is located just behind the power truck bogie and ahead of the rail positioning device so that the two bogies of the second truck roll on the freshly laid track.

French Patent Appln. No. FR-A-2,419,998 filed by the same Applicant describes a railroad track removal train which is also adapted to be converted into a train for laying a new track. Like the above-mentioned trains, the train described in French Patent Appln. No. FR-A-2,419,998 is composed of two hingedly interconnected working trucks supporting the various working tools and machines. The essential difference existing between this train and the previous ones is that the single bogie of the power truck is already rolling on the new track while the bogie of the tie handling truck, which travels in the working area, is mounted on a translation system adapted to slide or roll in the rail seats cut in the old railless cross-ties. The second bogie of the same car rolls on the old track together with the various storage cars. To convert this last-mentioned train into a train for laying a new track, the direction of travel is reversed and the single bogie of the second hinged truck is provided with tires enabling it to travel on the track platform while the second translation device supporting one of the bogies of the second truck travels on the laid track and the second bogie and the storage cars roll on the laid track.

The previously mentioned railroad track laying trains are objectionable in that the power vehicle or in any case the first working truck must travel while bearing either on rails laid directly upon the platform or, in the absence thereof, directly on the platform proper. In either case the load supported by the platform is localized at the positions of the rolling bearings so that the pressure exerted on the platform without the ties is extremely high. This load localization is attended by the destruction of the platform profile. In fact, it is particularly important, prior to laying the ties and rails, to level and profile the platform as a function of the geometrical configuration of the track and also of the specific nature of the soil (slope in curved sections, platform inclination for draining rainwater, etc.). Therefore, after the passage of the power vehicle or after the track-laying operation, the platform must be reprofiled, thus increasing costs and extending the track construction time. In case the profile were not restored, a local settling or even a total destruction of the track might result. Furthermore, constituting a runway by laying rails directly on the platform is an inconvenience per se.

SUMMARY OF THE INVENTION

It is the primary object of the present invention to avoid the inconveniences broadly set forth hereinabove by eliminating the rolling means bearing directly on the platform free of ties, or on a runway or any kind.

The track laying train according to the instant invention is characterized by the fact that the means for transporting and laying the ties and the rail positioning means are supported by a single truck provided with two bogies, that the tie laying means are mounted in overhanging relationship in front of the leading bogie of the truck, that said leading bogie is supported during the work by a translation device sliding or rolling in the rail seats cut in the railless cross-ties, and that the rail positioning means are disposed between the translation device and the rear bogie of the same truck. As the truck travels on the ties through one of its bogies by means of a translation device, the pressure exerted on the platform is relatively low and no platform distortion is produced. The rails are positioned after the passage of the translation device so that the rear bogie rolls on the previously laid rails. The power unit is located in the vicinity of this rear bogie so that the load exerted on the railless ties is kept at a value as low as possible in order to avoid doing any damage thereto.

At the cost of minor transformations this train may be converted into a railroad renewal train.

THE DRAWINGS

Figure 2:
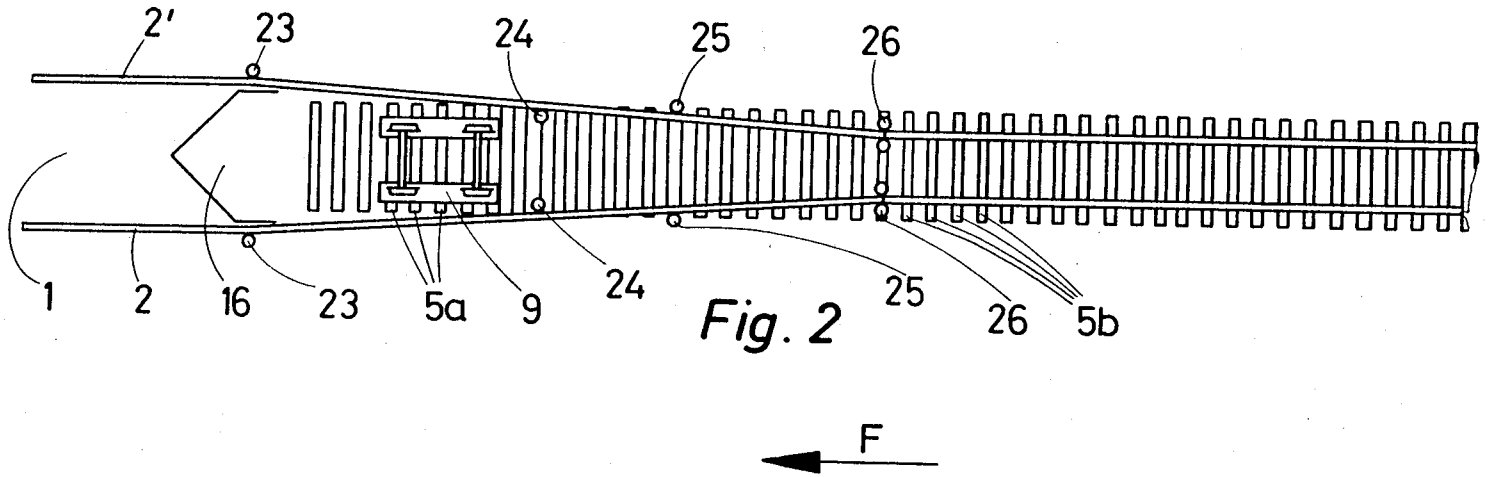
FIG. 2 is a plan view from above of the preceding Figure but showing only the cross-ties, the rails and the rail positioning device.
Figure 1:
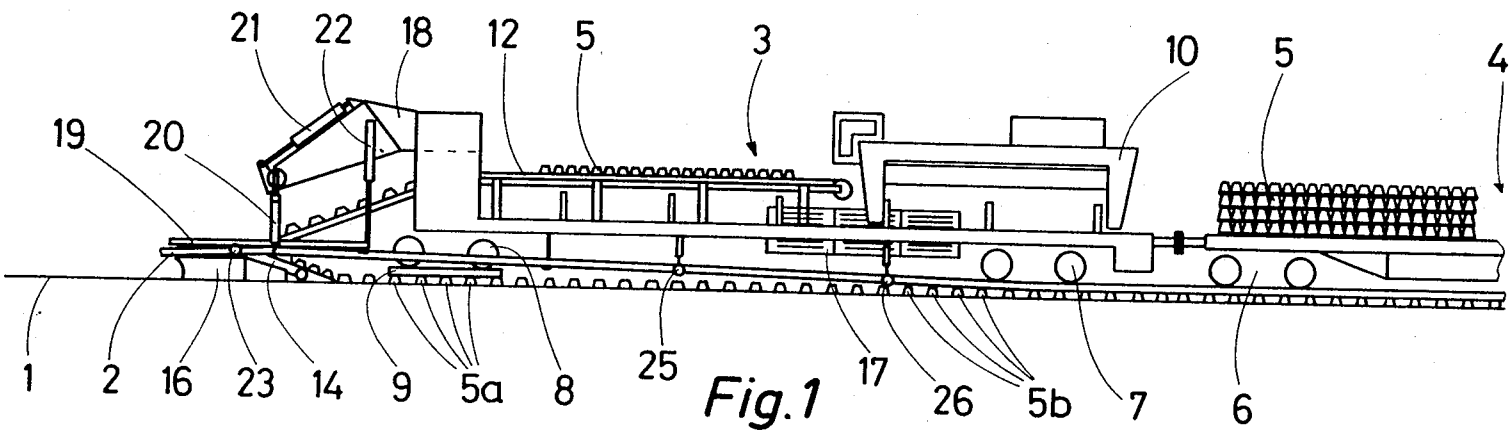
FIG. 1 is a diagrammatic side elevational view showing a train for laying a new railroad track according to a specific form of embodiment of the invention.

Referring to the drawings, the reference numeral 1 designates the profiled platform, 2 and 2' being the rails to be laid which are previously laid down at the side ends of the platform. The train is composed of a truck 3 supporting the various working means, and of several cars 4 for storing cross-ties 5 which are carried by bogies 6 rolling on the laid track. The truck 3 bears on the laid track through the rear bogie 7 and on the railless ties 5*a* through a front bogie 8 supported in turn by a translation device 9. This translation device 9 may consist of a sledge mounted on skates or casters like the one described in the French Patent No. FR-A-2,419,998. It is also possible, for relieving the translation device of an excessive load, to provide on either side of the bogie 8 retractable roller skates or caterpillar means moving on the ties as disclosed in the European Patent Application No. 0,060,590 filed by the same Applicants. With this device, the load distribution on the ties and the truck stability are improved considerably. The truck 3 is provided with a transport gantry 10 rolling on a continuous runway formed on the chassis of truck 3 and storage car 4, with means 12 for storing and transporting the cross-ties, a plurality of roller clamps 23, 24, 25, 26 for lifting and positioning the rails 2, 2', an overhanging bracket 18 supporting hinged means 14 for transporting and laying the ties 5, devices 16 for levelling and/or tamping the platform or ballast 1, and eventually a power unit 17 for driving the train and also the various working devices.

The levelling and/or tamping device 16 and the hinged device 14 for transporting and laying the ties are suspended from a frame 19 suspended in turn from the bracket 18 by means of fluid-operated cylinders 20, 21, 22 permitting of guiding the frame along the track axis.

The above-described track laying train operates as follows:

Firstly, the platform 1 is prepared and the rails 2, 2' are disposed at the side ends thereof, whereafter the truck 3 is caused to move in the direction of the arrow F on the ties 5*a* laid by the tie-laying device 14. The translation device 9 supporting the bogie 8 is guided by the rail seats forming notches cut in the ties 5*a*. The rails 2 are lifted by means of the roller clamps 23 disposed ahead of the front bogie 8 of truck 3, and brought back under the truck 3, after the passage of this bogie 8, by the clamps 24, 25, and eventually positioned in the rail seats of ties 5*b*. Meanwhile, the gantry 10 supplies cross-ties to the storage-conveyor 12.

It is also possible to lay the ties and rails directly upon the platform in the absence of any ballast, and to subsequently lift the track for laying the ballast.

Figure 3:
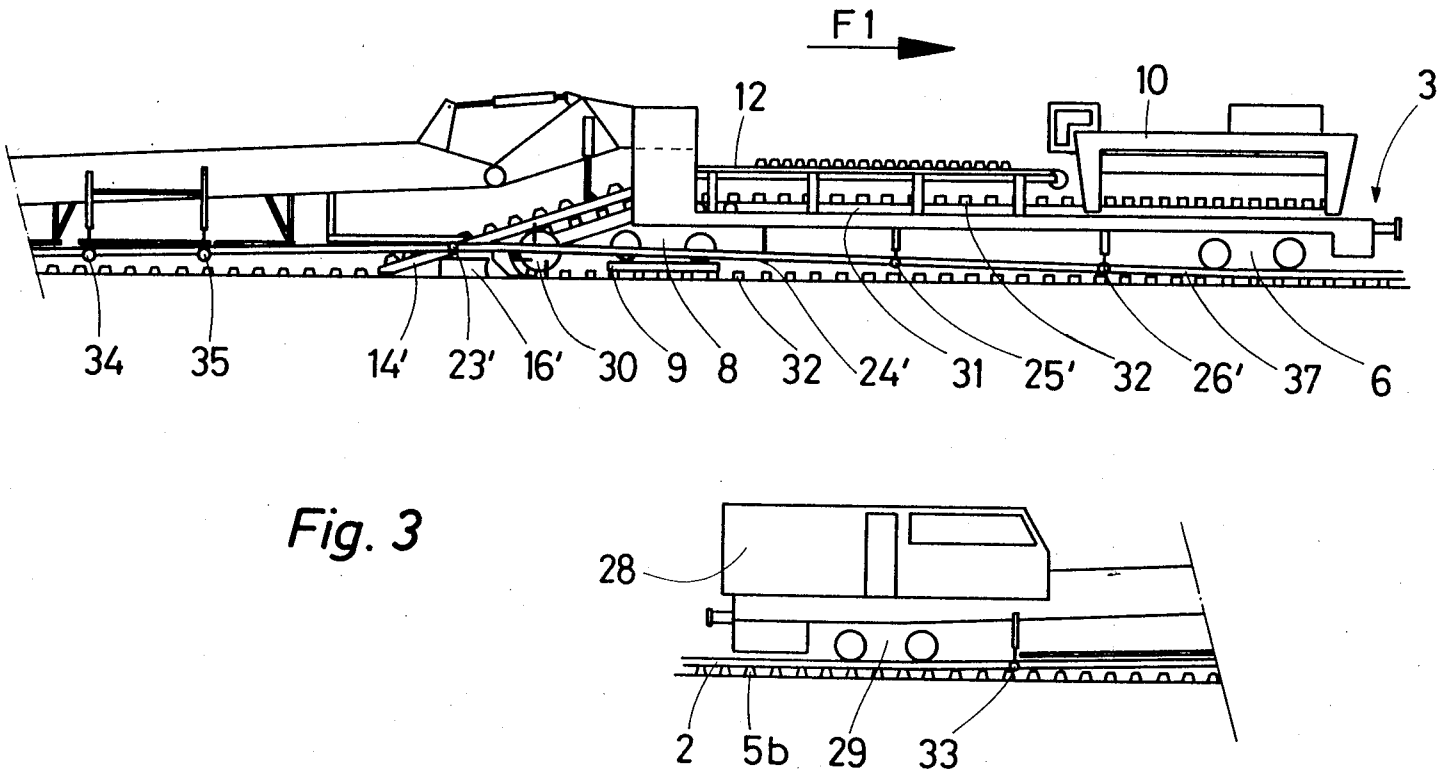
FIG. 3 illustrates diagrammatically in side elevational view the track laying train converted into a railrod track renewal train.

For converting the track laying train into a railroad track renewal train (FIG. 3) a self-propelled or power-driven truck 28 is coupled to the front end of the renewal train 3. This truck 28 is supported on a bogie 29 rolling on the newly laid rails 2, 2' set on the new ties 5*b*. The power-driven truck 28 is provided with means for positioning the new rails 33; 34; 35. The two trucks 3 and 28 are hingedly interconnected in a known fashion, notably as described in the above-mentioned French Patent No. FR-2,419,998. The engine 17 is removed and the space thus made available is occupied by means 31 for transporting the old ties 32, which are followed by the device 30 for removing the old ties.

As the track renewal train travels in the direction of the arrow F1 (which is opposed to the direction of travel of the track laying train) the tie laying device 14' is slightly modified with respect to the preceding device, thus leaving room for the devices 30 and 31 for removing and transporting the old ties, respectively. The old ties 32 are conveyed by the gantry 10 to the storage car 4.

Underneath the truck 3 a plurality of roller clamps 23', 24', 25', 26' are provided for lifting and divaricating the old rails 37. The translation device 9 is movable in the rail seats cut in the old ties 32. Disposed between the devices 14' for laying the new ties and 30 for removing the old ties is a ballast levelling and/or tamping device 16.

Though specific forms of embodiment of the present invention have been described and illustrated herein, it will readily occur to those conversant with the art that many modifications and changes may be brought thereto without departing from the basic principles of the invention.

What is claimed as new is:

1. A train for laying railroad track comprising cars for storing ties, means for transporting and laying ties, means for positioning rails on said ties, a single work truck supporting said tie transporting and laying means and said rail positioning means, said truck having a rear bogie and a front bogie, said rear bogie being disposed rearwardly of said rail positioning means and running on rails after they are positioned, said front bogie being disposed forwardly of said rail positioning means, translation means running on a plurality of railless ties supporting said front bogie, said tie laying means being mounted and operating in an overhanging relationship ahead of the front bogie of said truck to lay ties in front of said translation means.

2. A train for laying railroad track according to claim 1, wherein a power unit for said train is disposed on said truck in close vicinity to said rear bogie.

3. A train for laying railroad track according to claim 1, further comprising means mounted on the front end of said tie laying means for levelling the platform or ballast prior to laying said ties.

4. A train for laying railroad track according to claim 3, further comprising means mounted on the front end of said tie laying means for tamping the platform or ballast.

5. A train for laying railroad track according to claim 1, wherein said tie transporting means comprises a gantry running on a continuous runway provided on said truck and said tie-storing cars.

6. A train for laying railroad track according to claim 5, in which said tie transporting means further comprises a conveyor for transporting ties from said gantry to said tie laying means.

7. A train for laying railroad track according to claim 1, in which said rail positioning means comprises roller clamps at opposite sides of said truck for lifting and positioning the rails.

8. A train for laying railroad track according to claim 1, in which said translation means comprises a sledge mounted on a plurality of rolling elements.

9. A train for laying railroad track according to claim 1, further comprising means for converting the train into a railroad track renewal train, said means comprising a second truck hingedly interconnected with the front end of the aforesaid truck and provided with a bogie rolling on the new track, means for removing old rails and for removing and transporting old ties, a power unit disposed on said second truck and being adapted to drive said renewal train in a direction opposite to that of the railroad laying train, said tie laying means being adapted to operate in said opposite direction.

* * * * *